US005709149A

United States Patent [19]

Weber

[11] Patent Number: 5,709,149

[45] Date of Patent: Jan. 20, 1998

[54] APPARATUS FOR TENSIONING PRINTING PLATES ON A CYLINDER OF A ROTARY PRINTING MACHINE

[75] Inventor: Werner Weber, Sandhausen, Germany

[73] Assignee: Heidelberger Druckmaschinen Aktiengesellschaft, Heidelberg, Germany

[21] Appl. No.: 609,340

[22] Filed: Mar. 1, 1996

[30] Foreign Application Priority Data

Mar. 3, 1995 [DE] Germany ..... 195 07 368.1

[51] Int. Cl.[6] ..... B41F 1/28

[52] U.S. Cl. ..... 101/415.1; 101/DIG. 42

[58] Field of Search ..... 161/415.1; 101/DIG. 42

[56] References Cited

U.S. PATENT DOCUMENTS 5,367,954 11/1994 Becker ..... 101/415.1

FOREIGN PATENT DOCUMENTS 4244279 6/1994 Germany .

604708 4/1978 U.S.S.R. ..... 101/415.1

*Primary Examiner*—Edgar S. Burr

*Assistant Examiner*—Daniel J. Colilla

*Attorney, Agent, or Firm*—Nils H. Ljungman and Associates

[57] ABSTRACT

A device for tensioning printing formes (or "printing plates") on a forme (or "plate") cylinder of a rotary printing machine, including a stretching shaft extending through a gap formed in the cylinder, the stretching shaft holding receiving elements and, opposite thereof, clamping surfaces gripping the trailing end of a printing plate, with individual tensioning elements being mounted side by side on the stretching shaft, and the stretching shaft being stretchable, via adjusting elements, linearly in axial direction in order to optimally tension the trailing end of the printing plate independently of a possible stretching of the printing plate.

20 Claims, 2 Drawing Sheets

APPARATUS FOR TENSIONING PRINTING PLATES ON A CYLINDER OF A ROTARY PRINTING MACHINE

BACKGROUND OF THE INVENTION

1. Field of the Invention

The present invention generally relates to a device for tensioning formes (or "printing forms" or "printing plates") on a forme cylinder (e.g., a "plate cylinder") of a rotary printing machine, the device including an expansion shaft extending through a gap formed in the forme cylinder, the stretching shaft featuring receiving elements and, opposite thereof, clamping surfaces for gripping the trailing end of a printing forme, with a first receiving element being pivotable, by means of at least one adjusting element, against the force of clamping springs acting in a tensioning direction, and with a second receiving element featuring a holding element via which the receiving element is pivoted against the force of a tensioning spring, when actuating the adjusting element, individual tensioning elements being mounted side by side on the stretching shaft, and the stretching shaft being linearly stretchable, via adjusting elements, in an axial direction.

2. Background Information

German Patent No. 42 44 279 A1 shows an embodiment of this type in which individual tensioning elements are mounted on an expansion shaft so as to be fixed against rotation, with individual preloading elements acting on the tensioning elements independently of each other and affecting a rotation of the expansion shaft.

OBJECT OF THE INVENTION

It is one object of the present invention to optimally tension the trailing end of the printing forme independently of a possible stretching of the printing forme.

SUMMARY OF THE INVENTION

According to at least one preferred embodiment of the present invention, this object is achieved in that the tensioning elements are mounted on the stretching shaft so as to be freely pivotable, and that spacer rings are fastened to a stretchable shaft, the spacer rings engaging in recesses formed in the tensioning elements and guiding the tensioning elements without play in the axial direction. With this solution, the tensioning elements may be freely adjusted to the end of the printing forme, without influencing each other. This solution makes it possible to stretch the stretching shaft, and thus the printing forme, independently of the tensioning of the printing forme in the circumferential direction, if, due to respective printing conditions, the trailing end of the printing carrier has been stretched. Of course, the trailing end of the printing forme can be stretched by means of the stretching shaft, with the printing forme end being clamped.

In one advantageous embodiment of the invention, supporting bearings for the stretching shaft are provided between the tensioning elements, thus ensuring that the tensioning elements are precisely mounted and that the printing forme is stretched uniformly.

The fact that the stretching shaft may be axially stretched by means of adjusting screws rotatably supported in the front ends (or end faces) of the cylinder represents a further advantage of the invention. This makes it possible to easily mount the stretching shaft on the cylinder.

In order to reduce the forces required, the stretching shaft features necked portions in the region of the tensioning elements.

The above-discussed embodiments of the present invention will be described further hereinbelow with reference to the accompanying figures.

When the word "invention" is used in this specification, the word "invention" includes "inventions", that is, the plural of "invention". By stating "invention", the Applicant (s) does/do not in any way admit that the present application does not include more than one patentably and non-obviously distinct invention, and maintains that this application may include more than one patentably and non-obviously distinct invention. The Applicant(s) hereby assert (s) that the disclosure of this application may include more than one invention, and, in the event that there is more than one invention, that these inventions may be patentable and non-obvious one with respect to the other.

One aspect of the invention resides broadly in a tensioning apparatus for tensioning a printing plate on a cylinder of a rotary printing press, the cylinder having a substantially central axis of rotation, a generally cylindrical peripheral surface, and a cavity extending radially inward from the generally cylindrical peripheral surface of the cylinder, the cavity additionally having a longitudinal axis extending substantially parallel to the axis of rotation of the cylinder, the tensioning apparatus including: a shaft member disposed within the cavity and having a longitudinal axis extending substantially parallel to the longitudinal axis of the cavity; at least one tensioning member pivotal about the longitudinal axis of the shaft member; the at least one tensioning member including a first clamping surface; at least one clamping member; the at least one clamping member including a second clamping surface; urging means for urging the first and second clamping surfaces toward one another; the first and second clamping surfaces opposing one another and a portion of the printing plate being positionable and clampable between the first and second clamping surfaces; biasing means for exerting a rotational biasing force on the at least one tensioning member pivotally about the longitudinal axis of the shaft member in a first rotational direction to thereby increase tension applied to a printing plate positioned and clamped between the first and second clamping surfaces; adjustment means for rotating the at least one tensioning member in a second rotational direction against the biasing force exerted by the biasing means to thereby decrease tension applied to a printing plate positioned and clamped between the first and second clamping surfaces, the second rotational direction being substantially opposite to the first rotational direction; axial extension adjustment means for altering the length of the shaft member along the longitudinal axis of the shaft member; and axial alignment means for maintaining the at least one tensioning member and the shaft member in a substantially constant relative alignment along the longitudinal axis of said shaft member during the alteration of the length of the shaft member along the longitudinal axis of the shaft member by the axial extension adjustment means.

Another aspect of the invention resides broadly in a tensioning apparatus for tensioning a printing plate on a cylinder of a rotary printing press, the cylinder having a substantially central axis of rotation, a generally cylindrical peripheral surface, and a cavity extending radially inward from the generally cylindrical peripheral surface of the cylinder, the cavity additionally having a longitudinal axis extending substantially parallel to the axis of rotation of the cylinder, the tensioning apparatus including: a shaft member disposed within the cavity and having a longitudinal axis extending substantially parallel to the longitudinal axis of the cavity; and at least one tensioning and clamping device rotatably mounted on the shaft member, the at least one tensioning and clamping device including: a tensioning lever arm rotatably mounted on the shaft member, the tensioning lever arm being rotatable about the longitudinal axis of the shaft member; the tensioning lever arm including a first end disposed on a first side of the longitudinal axis of the shaft member; the tensioning lever arm additionally including a second end disposed on a second side of the longitudinal axis of the shaft member opposite to the first side of the longitudinal axis of the shaft member, the second end of the tensioning lever arm including a first clamping surface; a clamping lever arm; the clamping lever arm having a first end pivotally connected to the first end of the tensioning lever arm at a pivot point; the clamping lever arm having a second end disposed on the second side of the longitudinal axis of the shaft member; the second end of the clamping lever am including a second clamping surface; a first camming surface provided on the cylinder of the rotary printing press; a second camming surface provided on the clamping lever arm intermediate the first end of the clamping lever arm and the second end of the clamping lever arm, the second camming surface being in contact with the first camming surface, and the second camming surface being translatable along the first camming surface biasing means for biasing the tensioning lever arm in a first rotational direction about the longitudinal axis of the shaft member; adjustment means for rotating the tensioning lever arm in a second rotational direction about the longitudinal axis of the shaft member, the second rotational direction being opposite to the first rotational direction; axial extension adjustment means for adjusting the axial length of the shaft member; and axial alignment means for substantially restricting relative axial movement between the at least one tensioning and clamping device and the shaft member.

Yet another aspect of the invention resides broadly in a tensioning apparatus for tensioning a printing plate on a cylinder of a rotary printing press, the cylinder having a substantially central axis of rotation, a generally cylindrical peripheral surface, and a cavity extending radially inward from the generally cylindrical peripheral surface of the cylinder, the cavity additionally having a longitudinal axis extending substantially parallel to the axis of rotation of the cylinder, the tensioning apparatus including: a shaft member disposed within the cavity and having a longitudinal axis extending substantially parallel to the longitudinal axis of the cavity; and at least one tensioning and clamping device rotatably mounted on the shaft member, the at least one tensioning and clamping device including: a tensioning lever arm rotatably mounted on the shaft member, the tensioning lever arm being rotatable about the longitudinal axis of the shaft member; the tensioning lever arm including a first end disposed on a first side of the longitudinal axis of the shaft member; the tensioning lever arm additionally including a second end disposed on a second side of the longitudinal axis of the shaft member opposite to the first side of the longitudinal axis of the shaft member, the second end of the tensioning lever arm including a first clamping surface; a clamping lever arm; the clamping lever arm having a first end pivotally connected to the tensioning lever arm at a pivot point; the clamping lever arm having a second end opposite to the first end; the second end of the clamping lever arm including a second clamping surface; biasing means for biasing the tensioning lever arm in a first rotational direction about the longitudinal axis of the shaft member; adjustment means for rotating the tensioning lever arm in a second rotational direction about the longitudinal axis of the shaft member, the second rotational direction being opposite to the first rotational direction; axial extension adjustment means for adjusting the axial length of the shaft member; and axial alignment means for substantially restricting relative axial movement between the at least one tensioning and clamping device and the shaft member.

BRIEF DESCRIPTION OF THE DRAWINGS

A preferred embodiment of the invention is illustrated in the accompanying drawings, wherein.

DESCRIPTION OF THE PREFERRED EMBODIMENT

Figure 1:
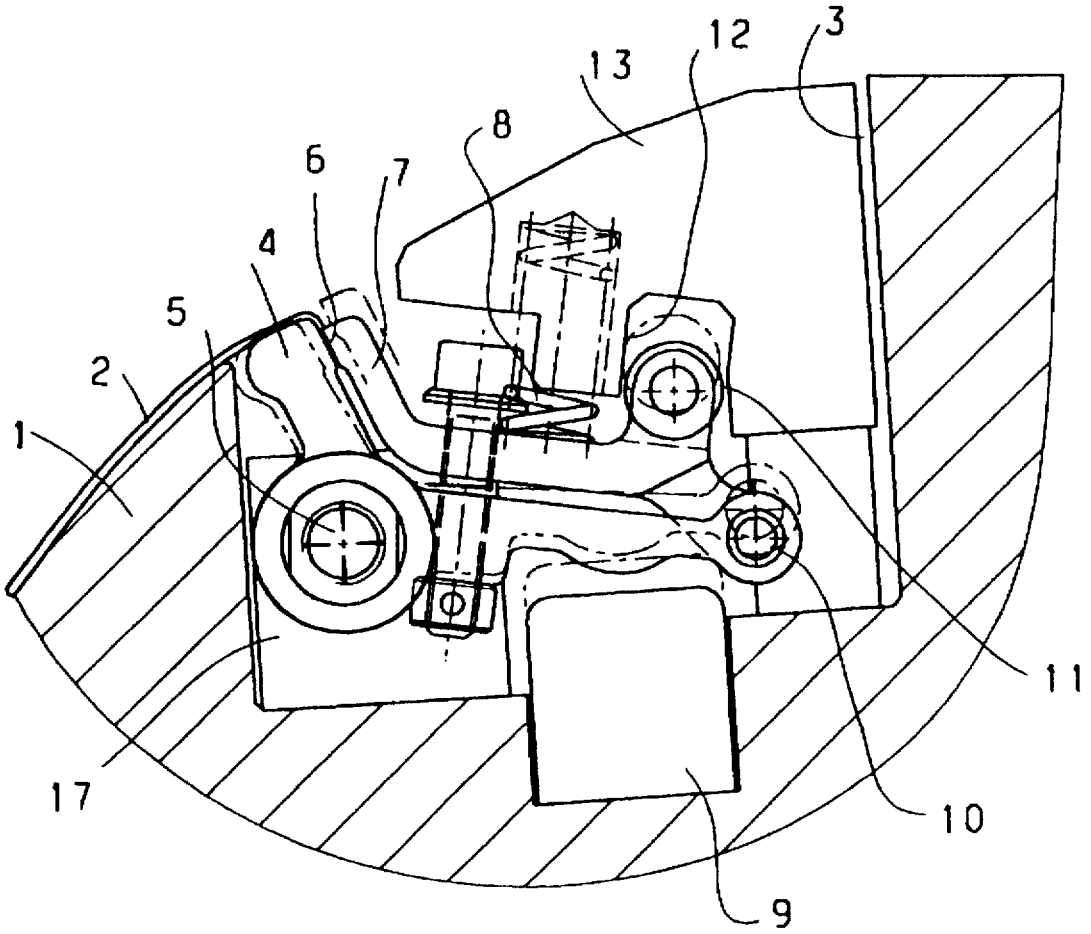
FIG. 1 is a side elevational view of the inventive tensioning device provided in the forme cylinder.

Referring initially to FIG. 1, receiving elements provided in a gap 3 formed in a forme cylinder (or a "printing plate cylinder") 1 tension a printing forme (or a "printing plate") 2 on the forme cylinder 1. The receiving elements include individual tensioning elements 4 mounted side by side on a stretching shaft 5. Clamping levers 7 which, under the action of tension springs 8, have clamping and tensioning effects, serve as holding elements for holding the trailing end 6 of the printing forme 2.

Adjusting elements designed, for example, as pneumatic units 9 make it possible to slacken the printing forme 2 and to release the end 6 of the printing forme 2. For this purpose, the pneumatic elements 9 are lifted to a position shown by a broken lines so that the tensioning element 4 is rotated counterclockwise, and, at the same time, the clamping levers 7 are opened against the force of the tensioning springs 8. The tensioning elements 4 and the clamping levers 7 are connected to each other via pins 10. When opening the clamping lever 7, small rolls 11 mounted on the clamping levers 7 are engaged at a surface 12 of a cover 13 of the cylinder 1 so that the end 6 of the printing forme 2 is released.

Figure 2:
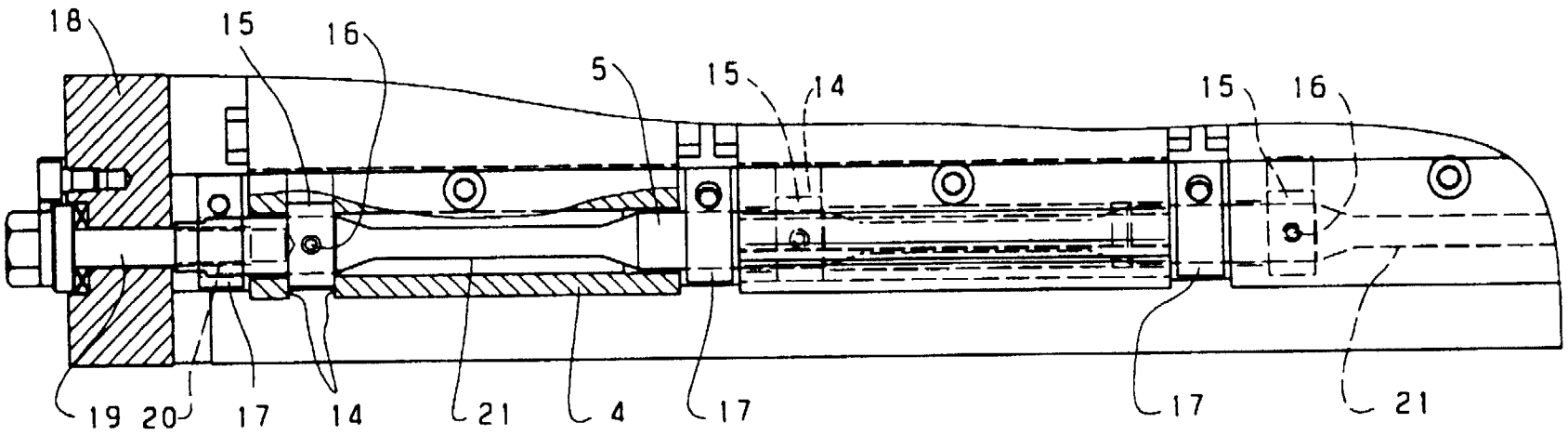
FIG. 2 is partial sectional view of the inventive tensioning device and the stretching shaft direction.

FIG. 2 shows depressions or recesses 14 formed in the tensioning elements 4, and ring shaped members in the form of spacer rings 15 being guided in said recesses 14 axially and without play. Via pins 16, the spacer rings 15 are firmly connected to the stretching shaft 5. This guarantees that, when axially stretching the stretching shaft 5, the clamped end 6 of the printing forme 2 may be axially stretched via the tensioning elements 4 and the clamping levers 7.

In order to ensure that the stretching shaft 5 is precisely mounted and aligned, supporting bearings 17 fastened to the bottom of the gap 3 are provided between the tensioning elements 4. This guarantees that the printing forme 2 is uniformly tensioned on the entire outer cylindrical surface of the forme cylinder 1.

For axially stretching the stretching shaft 5, adjusting screws 19 are supported in the front ends (or end faces) 18 of the cylinder 1 on both sides of the stretching shaft 5, wherein the thread 20 of a respective adjusting screw 19 engaging in a threaded bore provided in the front end side of the stretching shaft 5. By rotating an adjusting screw 19, the stretching shaft 5 may be stretched in the axial direction. In order to reduce the forces required for this purpose and to ensure a uniform stretching of the stretching shaft 5, the stretching shaft 5 features necked portions 21 in the region of the tensioning elements 4.

The present invention is seen as having a number of alternative applications as concerns the arrangement of the stretching shaft 5 and its movement with respect to the cylinder 1. In this regard, and referring again to FIG. 2, the stretching shaft 5 may, in one embodiment of the invention, extend across substantially the entire width of the cylinder 1 as substantially one integral member. In this embodiment, the adjusting screws 19, which may be provided on both end faces of the cylinder 1, may act in at least two different ways to affect the movement and tensioning of the printing plate 2 clamped between the tensioning elements 4 and the clamping levers 7.

First, by operating the adjusting screws 19 in opposition to one another, the stretching shaft 5 may be either axially compressed or axially expanded, thereby exerting a corresponding axial expansion or compression force (that is, a force parallel to the longitudinal axis of the stretching shaft 5) on the printing plate 2 gripped between the tensioning elements 4 and the clamping levers 7.

Secondly, by operating the adjusting screws 19 in tandem with one another (that is, moving in the same relative direction), the entire stretching shaft 5 may be shifted in either of the opposite axial directions, without any appreciable axial compression or expansion forces being applied thereto or to the clamped printing plate 2. Such a movement of the stretching shaft 5 thereby exerts an "oblique" stretching force on the clamped printing plate 2, without any substantial associated axial expansion or compression force.

Additionally, of course, various adjustments can be made to the adjusting screws 19 which will effect various degrees of combined oblique movement combined with various degrees of axial compression or expansion.

Moreover, in another embodiment of the invention, the stretching shaft 5 can be provided as two partial shaft members, with a first partial shaft member extending axially inward from one of the end faces 18 of the cylinder 1 and terminating short of the other end face, and a second partial shaft member extending inward from the other end face 18 of the cylinder 1 and terminating short of the one end face. Such an embodiment allows independent movement of each of the partial shaft members and enables different degrees of movement and stretching of the printing plate 2 to be effected.

One feature of the invention resides broadly in the device for tensioning printing formes on a forme cylinder of a rotary printing machine comprising a stretching shaft extending through a gap formed in said forme cylinder, said stretching shaft holding receiving elements and, opposite thereof, clamping surfaces for gripping the trailing end of a printing forme, a first receiving element being pivotable, by means of at least one adjusting element, against the force of tensioning springs acting in tensioning direction, and a second receiving element featuring a holding element via which, when actuating laid adjusting element, said receiving element may be pivoted against the force of a tensioning spring, with individual tensioning elements being mounted side by side on said stretching shaft, and with said stretching shaft being linearly stretchable in axial direction via adjusting elements, characterized in that tensioning elements 4 are mounted on stretching shaft 5 so as to be freely pivotable, and that spacer rings 15 engaging in recesses 14 provided at tensioning elements 4 are fastened to said stretching shaft 5 and guide said tensioning elements 4 without play in axial direction.

Another feature of the invention resides broadly in the device characterized in that support bearings 17 supporting the stretching shaft 5 are provided between the tensioning elements 4.

Yet another feature of the invention resides broadly in the device characterized in that the stretching shaft 5 may be stretched in axial direction by means of adjusting screws 19 rotatably supported in front ends of the cylinder 18.

Still another feature of the invention resides broadly in the device characterized in that the region of the tensioning elements 4 the stretching shaft 5 features necked portions 21.

Some examples of devices for attaching printing plates to a cylinder of a rotary printing press which may be utilized in conjunction with the present invention are to be found in U.S. Pat. No. 5,488,904, issued to Kleinschmidt et al. on Feb. 6, 1996 and entitled "Device for Pivotably Adjusting Flexible Printing Plates on the Plate Cylinder of a Rotary Printing Machine"; U.S. Pat. No. 5,440,984, issued to Becker on Aug. 15, 1995 and entitled "Device for Clamping Flexible Printing Plates on the Plate Cylinder of Rotary Printing Presses"; U.S. Pat. No. 5,435,242, issued to Kusch et al. on Jul. 25, 1995 and entitled "Plate Cylinder for a Printing Press Having Plate Material in a Cartridge within the Plate Cylinder;" U.S. Pat. No. 5,230,284, issued to Kelm on Jul. 27, 1993 and entitled "Mechanism for Adjusting Forme Rollers at the Plate Cylinder of a Rotary Printing Machine"; U.S. Pat. No. 5,178,068, issued to Junghans, et al. on Jan. 12, 1993 and entitled "Print Unit Cylinder for Rotary Presses"; U.S. Pat. No. 5,090,319, issued to Weber et al. on Feb. 25, 1992 and entitled "Printing Unit Cylinder for a Rotary Printing Machine"; U.S. Pat. No. 5,088,409, issued to Roskosch on Feb. 18, 1992 and entitled "Device for Adjusting a Flexible Printing Plate on a Plate Cylinder of a Rotary Printing Press"; U.S. Pat. No. 5,014,619, issued to Jeschke on May 14, 1991 and entitled "Device for Tensioning Flexible Printing Plates on a Plate Cylinder of a Rotary Printing Machine"; U.S. Pat. No. 4,831,931, issued to Jeschke et al. on May 23, 1989 and entitled "Device for Tensioning a Flexible Printing Plate on a Plate Cylinder of a Rotary Printing Machine", each of these patents being hereby expressly incorporated by reference herein.

Examples of pneumatic adjusting devices which may be used in conjunction with the present invention are disclosed in U.S. Pat. No. 5,406,665, issued to Czopek et al. on Apr. 18, 1995 and entitled "Pneumatic Mechanism for Adjusting a Glass Sheet Washing Machine"; U.S. Pat. No. 5,392,885, issued to Patzenhauen et al. on Feb. 28, 1995 and entitled "Adjustable Hydraulic Vibration Damper for Motor Vehicles"; and U.S. Pat. No. 5,390,497, issued to Cottam on Feb. 21, 1995 and entitled "Self-Adjusting Clutch Actuator", each of these patents being expressly incorporated by reference herein.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 195 07 368.1, filed on Mar. 3, 1995, having inventor Werner Weber, and DE-OS P 195 07 368.1 and DE-PS P 195 07 368.1, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS 1. forme (or "plate") cylinder
2. printing forme (or "plate")
3. gap
4. tensioning element
5. stretching shaft
6. end
7. clamping lever
8. tensioning spring
9. pneumatic unit
10. pin
11. small roll
12. surface
13. cover
14. recess
15. spacer ring
16. pin
17. supporting bearing
18. front end of cylinder
19. adjusting screw
20. thread
21. necked portion

What is claimed is:

1. A device for tensioning a printing plate on a cylinder of a rotary printing press, said device comprising:

retaining apparatus to retain an end of a printing plate to a cylinder of a rotary printing press;

said retaining apparatus comprising a shaft;

said shaft being configured to be at least partially disposed within a cavity of a cylinder of a rotary printing press;

said shaft having a longitudinal axis;

said retaining apparatus comprising a tensioning element;

said tensioning element being rotatably disposed on said shaft;

said tensioning element being configured to retain at least a portion of an end of a printing plate to a cylinder of a rotary printing press;

stretching apparatus for stretching said shaft along the longitudinal axis;

said stretching apparatus comprising a ring-shaped member;

said ring-shaped member being fixedly disposed on said shaft;

said tensioning element comprising a depression being disposed adjacent said shaft;

said ring-shaped member being at least partially disposed in said depression of said tensioning element; and said depression of said tensioning element and said ring-shaped member each having dimensions to minimize relative axial movement between said tensioning element and said ring-shaped member.

2. The device according to claim 1, wherein:

said tensioning element is a first tensioning element;

said ring-shaped member is a first ring-shaped member;

said retaining apparatus comprises a second tensioning element;

said second tensioning element is rotatably disposed on said shaft;

said second tensioning element is coaxial with said first tensioning element;

said stretching apparatus comprises a second ring-shaped member fixedly attached to said shaft;

said second tensioning element comprises a depression disposed adjacent said shaft;

said second ring-shaped member is at least partially disposed in said depression of said second tensioning element; and said depression of said second tensioning element and said second ring-shaped member each have dimensions to minimize relative axial movement between said second tensioning element and said second ring-shaped member.

3. The device according to claim 2, wherein:

said device comprises a support bearing;

said support bearing is configured to be mounted on a cylinder of a rotary printing press to rotatably mount said shaft to a cylinder of a rotary printing press;

said shaft extends through said support bearing; and said support bearing is disposed between said first and second tensioning elements.

4. The device according to claim 3, wherein:

said shaft is configured to be disposed between a first face portion and a second face portion of a cylinder of a rotary printing press;

said shaft comprises a first end and an axially opposite second end;

said first end of said shaft is configured to be disposed adjacent a first face portion of a cylinder of a rotary printing press;

said shaft comprises a threaded bore extending from said first end of said shaft towards said second end of said shaft;

said threaded bore of said shaft extends substantially parallel to the longitudinal axis of said shaft;

said stretching apparatus comprises a screw;

said screw is configured to be rotatably supported within a first face portion of a cylinder of a rotary printing press;

said screw is configured to abut a first face portion of a cylinder of a rotary printing press to limit axial movement of said screw towards said shaft; and said screw is configured and disposed to threadingly engage said threaded bore of said shaft to permit adjustment of the stretching of said shaft.

5. The device according to claim 4, wherein:

said screw is a first screw;

said threaded bore of said shaft is a first threaded bore of said shaft;

said second end of said shaft is configured to be disposed adjacent a second face portion of a cylinder of a rotary printing press;

said shaft comprises a second threaded bore extending from said second end of said shaft towards said first end of said shaft;

said second threaded bore of said shaft extends substantially parallel to the longitudinal axis of said shaft;

said stretching apparatus comprises a second screw;

said second screw is configured to be rotatably supported within a second face portion of a cylinder of a rotary printing press;

said second screw is configured to abut a second face portion of a cylinder of a rotary printing press to limit axial movement of said second screw towards said shaft; and said second screw is configured and disposed to threadingly engage said second threaded bore of said shaft to permit a second adjustment of the stretching of said shaft.

6. The device according to claim 5, wherein:

said shaft comprises a necked portion having a reduced cross sectional area; and said necked portion of said shaft is disposed adjacent said first tensioning element.

7. The device according to claim 6, wherein:

said necked portion of said shaft is a first necked portion of said shaft;

said shaft comprises a second necked portion having a reduced cross sectional area; and said second necked portion of said shaft is disposed adjacent said second tensioning element.

8. The device according to claim 7, wherein:

said retaining apparatus comprises at least one clamping lever;

said at least one clamping lever comprises a surface;

said surface of said at least one clamping lever is configured and disposed to grip an end of a printing plate on a cylinder of a rotary printing press between said surface and said first and second tensioning elements;

said retaining apparatus comprises at least one adjustment element;

said at least one adjustment element is configured and disposed to rotate said first and second tensioning elements in a first direction about said shaft to permit insertion and extraction of an edge of a printing plate on a rotary printing press to and from said retaining apparatus;

said at least one adjustment element is configured and disposed to rotate said first and second tensioning elements in a second direction about said shaft to retain and tension a printing plate on a rotary printing press with said retaining apparatus;

said retaining apparatus comprises at least one spring; and said at least one spring is configured and disposed to apply a force to urge rotation of at least one of said first and second tensioning elements in the second direction.

9. The device according to claim 2, wherein:

said shaft is configured to be disposed between a first face portion and a second face portion of a cylinder of a rotary printing press;

said shaft comprises a first end and an axially opposite second end;

said first end of said shaft is configured to be disposed adjacent a first face portion of a cylinder of a rotary printing press;

said shaft comprises a threaded bore extending from said first end of said shaft towards said second end of said shaft;

said threaded bore of said shaft extends substantially parallel to the longitudinal axis of said shaft;

said stretching apparatus comprises a screw;

said screw is configured to be rotatably supported within a first face portion of a cylinder of a rotary printing press;

said screw is configured to abut a first face portion of a cylinder of a rotary printing press to limit axial movement of said screw towards said shaft; and said screw is configured and disposed to threadingly engage said threaded bore of said shaft to permit adjustment of the stretching of said shaft.

10. The device according to claim 9, wherein:

said screw is a first screw;

said threaded bore of said shaft is a first threaded bore of said shaft;

said second end of said shaft is configured to be disposed adjacent a second face portion of a cylinder of a rotary printing press;

said shaft comprises a second threaded bore extending from said second end of said shaft towards said first end of said shaft;

said second threaded bore of said shaft extends substantially parallel to the longitudinal axis of said shaft;

said stretching apparatus comprises a second screw;

said second screw is configured to be rotatably supported within a second face portion of a cylinder of a rotary printing press;

said second screw is configured to abut a second face portion of a cylinder of a rotary printing press to limit axial movement of said second screw towards said shaft; and said second screw is configured and disposed to threadingly engage said second threaded bore of said shaft to permit a second adjustment of the stretching of said shaft.

11. The device according to claim 10, wherein:

said shaft comprises a necked portion having a reduced cross sectional area; and said necked portion of said shaft is disposed adjacent said first tensioning element.

12. The device according to claim 11, wherein:

said necked portion of said shaft is a first necked portion of said shaft;

said shaft comprises a second necked portion having a reduced cross sectional area; and said second necked portion of said shaft is disposed adjacent said second tensioning element.

13. The device according to claim 12, wherein:

said device comprises a support bearing;

said support bearing is configured to be mounted on a cylinder of a rotary printing press to rotatably mount said shaft to a cylinder of a rotary printing press;

said shaft extends through said support bearing; and said support bearing is disposed between said first and second tensioning elements.

14. The device according to claim 13, wherein:

each of said first and second ring-shaped members are pinned to said shaft;

said retaining apparatus comprises at least one clamping lever;

said at least one clamping lever comprises a surface;

said surface of said at least one clamping lever is configured and disposed to grip an end of a printing plate on a cylinder of a rotary printing press between said surface and said first and second tensioning elements;

said retaining apparatus comprises at least one adjustment element;

said at least one adjustment element is configured and disposed to rotate said first and second tensioning elements in a first direction about said shaft to permit insertion and extraction of an edge of a printing plate on a rotary printing press to and from said retaining apparatus;

said at least one adjustment element is configured and disposed to rotate said first and second tensioning elements in a second direction about said shaft to retain and tension a printing plate on a rotary printing press with said retaining apparatus;

said retaining apparatus comprises at least one spring; and said at least one spring is configured and disposed to apply a force to urge rotation of at least one of said first and second tensioning elements in the second direction.

15. The device according to claim 2, wherein:

said shaft comprises a necked portion having a reduced cross sectional area; and said necked portion of said shaft is disposed adjacent said first tensioning element.

16. The device according to claim 15, wherein:

said necked portion of said shaft is a first necked portion of said shaft;

said shaft comprises a second necked portion having a reduced cross sectional area; and said second necked portion of said shaft is disposed adjacent said second tensioning element.

17. The device according to claim 16, wherein:

said device comprises a support bearing;

said support bearing is configured to be mounted on a cylinder of a rotary printing press to rotatably mount said shaft to a cylinder of a rotary printing press;

said shaft extends through said support bearing; and said support bearing is disposed between said first and second tensioning elements.

18. The device according to claim 17, wherein:

said shaft is configured to be disposed between a first face portion and a second face portion of a cylinder of a rotary printing press;

said shaft comprises a first end and an axially opposite second end;

said first end of said shaft is configured to be disposed adjacent a first face portion of a cylinder of a rotary printing press;

said shaft comprises a threaded bore extending from said first end of said shaft towards said second end of said shaft;

said threaded bore of said shaft extends substantially parallel to the longitudinal axis of said shaft;

said stretching apparatus comprises a screw;

said screw is configured to be rotatably supported within a first face portion of a cylinder of a rotary printing press;

said screw is configured to abut a first face portion of a cylinder of a rotary printing press to limit axial movement of said screw towards said shaft; and said screw is configured and disposed to threadingly engage said threaded bore of said shaft to permit adjustment of the stretching of said shaft.

19. The device according to claim 18, wherein:

said screw is a first screw;

said threaded bore of said shaft is a first threaded bore of said shaft;

said second end of said shaft is configured to be disposed adjacent a second face portion of a cylinder of a rotary printing press;

said shaft comprises a second threaded bore extending from said second end of said shaft towards said first end of said shaft;

said second threaded bore of said shaft extends substantially parallel to the longitudinal axis of said shaft;

said stretching apparatus comprises a second screw;

said second screw is configured to be rotatably supported within a second face portion of a cylinder of a rotary printing press;

said second screw is configured to abut a second face portion of a cylinder of a rotary printing press to limit axial movement of said second screw towards said shaft; and said second screw is configured and disposed to threadingly engage said second threaded bore of said shaft to permit a second adjustment of the stretching of said shaft.

20. The device according to claim 19, wherein:

said retaining apparatus comprises at least one clamping lever;

said at least one clamping lever comprises a surface;

said surface of said at least one clamping lever is configured and disposed to grip an end of a printing plate on a cylinder of a rotary printing press between said surface and said first and second tensioning elements;

said retaining apparatus comprises at least one adjustment element;

said at least one adjustment element is configured and disposed to rotate said first and second tensioning elements in a first direction about said shaft to permit insertion and extraction of an edge of a printing plate on a rotary printing press to and from said retaining apparatus;

said at least one adjustment element is configured and disposed to rotate said first and second tensioning elements in a second direction about said shaft to retain and tension a printing plate on a rotary printing press with said retaining apparatus;

said at least one adjustment element comprises at least one pneumatic unit;

said retaining apparatus comprises at least one spring; and said at least one spring is configured and disposed to apply a force to urge rotation of at least one of said first and second tensioning elements in the second direction.

* * * * *

UNITED STATES PATENT AND TRADEMARK OFFICE

CERTIFICATE OF CORRECTION

PATENT NO. : 5,709,149

DATED : January 20, 1998

INVENTOR(S) : Werner WEBER

It is certified that error appears in the above-identified patent and that said Letters Patent is hereby corrected as shown below:

In column 4, line 13, after 'shaft' insert --in the longitudinal--.

Signed and Sealed this

Ninth Day of June, 1998

*Attest:*

*Attesting Officer*

Bruce Lehman

BRUCE LEHMAN

*Commissioner of Patents and Trademarks*